United States Patent [19]

Leers

[11] Patent Number: 5,015,300

[45] Date of Patent: May 14, 1991

[54] METHOD AND APPARATUS FOR ADJUSTING A PRESELECTED SWEEPING SURFACE WIDTH OF A REVOLVING ROLL-TYPE BRUSH

[75] Inventor: Konrad Leers, Wunstorf, Fed. Rep. of Germany

[73] Assignee: Schorling GmbH & Co. Waggonbau, Hanover, Fed. Rep. of Germany

[21] Appl. No.: 449,605

[22] Filed: Dec. 11, 1989

[30] Foreign Application Priority Data

Dec. 7, 1988 [DE] Fed. Rep. of Germany ..... 3841177
Dec. 7, 1988 [DE] Fed. Rep. of Germany ..... 3841178

[51] Int. Cl.[5] ..... B08B 7/04

[52] U.S. Cl. ..... 134/18; 51/165.74; 367/96

[58] Field of Search ..... 15/82; 134/18; 51/165.74, 165.76, 165.77; 367/96

[56] References Cited

U.S. PATENT DOCUMENTS 4,225,950 9/1980 Kotera et al. ..... 367/96
4,441,103 4/1984 Urabe ..... 51/165.76
4,572,253 2/1986 Farmer et al. ..... 367/96

FOREIGN PATENT DOCUMENTS 2821627 5/1978 Fed. Rep. of Germany ..... 15/82
3740215 6/1988 Fed. Rep. of Germany .

*Primary Examiner*—Theodore Morris
*Assistant Examiner*—Saeed Chaudhry
*Attorney, Agent, or Firm*—Collard, Roe & Galgano

[57] ABSTRACT

A method and apparatus is provided for adjusting a preselected sweeping area width of a revolving roll-type brush rotatable around an axis for the cleaning of roadways, airport runways and the like, wherein the spacing between the axis of the revolving brush and the surface to be cleaned is altered for adjusting the sweeping surface, or area swept, and wherein, for the dimensioning of the nominal spacing, the brush diameter is detected by means of a sensor and the spacing of the brush axis from the surface to be cleaned is adjusted according to the diameter of the revolving brush. The actual spacing between the brush axis and the surface to be cleaned is measured and when there are deviations between the nominal and the actual spacing, the spacing of the brush axis and the surface to be cleaned is readjusted to the desired nominal spacing by a control circuit in order to assure that a preselected sweeping surface width or width of the area swept is maintained.

22 Claims, 3 Drawing Sheets

METHOD AND APPARATUS FOR ADJUSTING A PRESELECTED SWEEPING SURFACE WIDTH OF A REVOLVING ROLL-TYPE BRUSH

The present invention relates to a method and apparatus for adjusting a preselected sweeping surface width of a revolving roll-type brush utilized in the cleaning of surfaces such as roads, airport runways, etc.

It is well known that vehicles having rotatable roll-type brushes are used for cleaning surfaces such as roadways or the runways of airports. For achieving an optimal cleaning result it is important, among other things, that the sweeping surface of the roll-type brush or the width of the sweeping surface, i.e., the contact surface between the revolving roll-type brush and the surface to be cleaned, be proper. When the sweeping surface is too small, the cleaning result is unsatisfactory, and where the sweeping surface is too great excessive wear of the revolving brush results. In addition, when cleaning roads or airport runways, residues of the revolving brush lead to a higher safety risk due to greater wear.

The single one-time adjustment at the start of the cleaning operation is inadequate because the diameter of the revolving brush is reduced by the constant wear, which in turn reduces the sweeping surface and cleaning effectiveness. Later readjustments made at periodic intervals offer only a partial but still inadequate solution because the cleaning property of the brush deteriorates constantly due to the reduction of the sweeping surface between adjustments, and because the cleaning operation, furthermore, must very often be interrupted for the new adjustment.

German patent document DE-OS 37 40 215 discloses a device in which the roll diameter of the revolving roll-type brush is determined and in which the spacing of the axis of the revolving brush from the surface to be cleaned is automatically changed depending on the decreasing diameter. By the use of such a device, the sweeping surface can be maintained approximately constant but only within certain limits. In the device according to this German patent document, sensor pins of a sensor are fastened on a swinging arm, whereby the sensor pins come into contact with the jacket surface of the revolving roll-type brush when the equipment is in operation. During operation, the sensor pins continuously generate pulses which are supplied to the actuating device. If the diameter of the revolving brush has been reduced by a certain amount due to wear, the pulses are broken. Both the revolving brush and the swinging arm of the sensor must be readjusted, whereupon pulses are collected or acquired again in a next phase until readjustment is required again due to wear. This known device is inaccurate because the diameter of the revolving brush is not exactly determined, but only a certain range of the diameter is monitored based on a permissible measure of wear.

It is a primary object of the present invention to provide a method and apparatus for adjusting a preselected sweeping surface width of a revolving roll-type brush permitting a significantly more accurate determination of the brush diameter as well as a significantly more accurate adjustment of a desired sweeping surface width in order to achieve an optimal cleaning result with low wear.

The above object is accomplished in accordance with the method of the present invention wherein the distance of displacement is measured which is travelled between a starting position of a scanning body and a position in which the scanning body comes into contact with the jacket surface of the revolving roll-type brush. In contacting the revolving brush, the bristles of the roll-type brush slide along the scanning body and, in so doing, cause the latter to oscillate. Such oscillations can be clearly detected by means of an acceleration receiver. In this method, the transition between nonexcitation of the scanning body and excitation by the bristles sliding along the scanning body is sufficiently drastic to permit an exact measurement of the distance of displacement.

According to another feature of the present invention, the roll-type brush diameter is determined at least at two different measuring sites of the jacket surface of the revolving brush. This permits detecting different degrees of wear and compensating for such differences, for example by changing the spacing between the brush axis and the surface to be cleaned to different degrees. In this way, the sweeping surface and consequently the cleaning result can be maintained constant across the entire length of the revolving brush.

Preferably, the scanning body is applied to the jacket surface only at preset time intervals. This factor reduces wear of the scanning body, which means that an extremely long service life can be achieved and readjustment of the sensor device need be made only at long service intervals. Since the measuring periods can be kept very short because of the clear indication of a contact with the jacket surface of the revolving brush, the advantageous properties achieved thereby can also be maintained when the individual measurements are taken at relatively short time intervals due to higher wear of the brush in order to permit readjustment of the revolving brush and thus of the sweeping surface in a manner adapted to the problem.

It is particularly advantageous to determine contact with the jacket surface of the revolving brush by means of sound. By the use of conventional components, the manufacturing and maintenance costs of such a device can be kept low while still achieving high operational reliability.

According to another feature of the present invention, the rotational speed of the revolving roll-type brush is controlled depending on the diameter of the roll-type brush so as to achieve a constant circumferential speed. This further enhances the cleaning effect, whereby devices already existing for the determination of the roll-type brush diameter can be used for controlling rotational speed.

In another embodiment of the method of the present invention, the method is not limited to determining only the diameter of the revolving brush. Rather, the actual spacing between the brush axis and the surface to be cleaned is measured in a novel manner. This measured quantity is compared with the nominal spacing between the brush axis and the surface to be cleaned which is derived on the basis of the detected diameter of the revolving brush. When the two values deviate from each other, readjustment of the axis position to the nominal spacing is effected. By additionally determining the actual spacing between the brush axis and the surface to be cleaned, it is possible to realize a control circuit in order to adjust for a spacing between the brush axis and the surface conforming to a desired constant sweeping surface.

According to yet another feature of the present invention, provision is made for continuously measuring the actual spacing between the brush axis and the surface to be cleaned, whereby a mean value of the measured values supplied by the measuring device is formed in terms of time in order to derive the actual spacing between the two. By forming the mean time value it is possible also to determine the level or static resting position of the brush axis above the surface to be cleaned. Furthermore, with the help of the additionally measured rolltype brush diameter it is possible to control the spacing between the brush axis and the surface to be cleaned. With a control circuit, the roll-type brush can be maintained above the surface in such a way that a preselected width of the sweeping surface is always assured.

According to yet another feature of the present invention, the measuring device is an ultrasound sensor stationarily mounted on the support and guide frame of the revolving brush. The actual spacing between the axis of the revolving brush and the surface to be cleaned can be determined very simply in a well known way with the use of ultrasound. Since ultrasound sensors are well known, the economic aspect of their use is advantageous. Incidentally, the ultrasound sensor can be mounted as an add-on on an existing support and guide device for the revolving brush. Preferably, the actual spacing is determined at different measuring points of the axis thereby assuring cylindrical wear of the revolving brush.

In the apparatus according to the first method embodiment, the scanning body is displaced by the advancing device from a starting position in the direction of the revolving roll-type brush, whereby the point of contact of the scanning body with the jacket surface of the revolving brush can be determined. This contact point is identifiable in that during the operation of this equipment, the bristles of the revolving brush slide across the scanning body, exciting the latter in the course of their sliding motion. The oscillations of this excitation can be detected and interpreted by means of an acceleration receiver. By means of a distance measuring device it is possible to determine exactly the distance travelled between the starting position of the scanning body and the position in which contact is made with the jacket surface of the revolving roll-type brush. Also, the device permits repeating the determination of the revolving brush diameter more frequently in order to check, on the one hand, the accuracy of the measurement itself, and to record, on the other hand, the progressing wear of the revolving brush and to change the adjusting device accordingly, i.e., as required by such wear.

In a practical embodiment, the scanning body is designed with a convex surface facing the jacket surface of the revolving brush, whereby the scanning body is arranged on a longitudinally displaceable bar of the advancing device. The convex design of the surface of the scanning body assures that when the scanning body comes into contact with the jacket surface of the revolving brush, the bristles of the latter will gradually slide up and down, which protects both the revolving brush and the scanning body against excessive wear and, furthermore, creates a clear point of contact with the bristles on the scanning body, which is advantageous to the accuracy of the measurement. With the longitudinally displaceable bar, the scanning body can be moved precisely in the axial direction irrespective of the brush diameter at the time, so that the additional distance of displacement which the advancing device must travel represents an exact measure of the reduction in the diameter of the revolving brush. Hence, complicated conversion of the measured data can be dispensed with.

In an advantageous embodiment of the invention, two sensor devices are arranged at different measuring points along the jacket surface of the revolving brush. According to another feature of the invention, provision is made for a sensor unit which is displaceable axially with respect to the revolving brush and thus displaceable to different measuring sites. This embodiment permits the detection of uneven wear of the revolving brush and compensation for such uneven wear, for example through different changes in the spacing between the brush axis and the surface to be cleaned in a way such that an even sweeping surface is obtained. This embodiment can be advantageously used for checking the revolving brush for wear as well as for checking the device for defects or failures.

In another practical embodiment of the invention, the scanning body contacts the jacket surface only at preset time intervals. In this manner, the scanning body is subject to very little wear and it has a long service life. Also, no additional wear of the revolving brush is caused by contact with the scanning body. Since these measurements require very short measuring time periods, the time intervals at which such measurements are carried out can be kept very short and adapted to the expected progress of wear without losing the advantage of reduced wear connected with this embodiment.

According to yet another feature of the present invention, the acceleration receiver is designed in the form of a body sound receiver. Such components are commercially available and are very reliable in operation. Since the further processing of the signals can be accomplished with conventional sub assemblies as well, the device can be constructed at favorable cost.

According to a further feature of the present invention, provision is made for a driving device for the revolving brush which is connected to the measuring and controlling device and controlled in such a way that the rotational speed is controlled depending on the revoling brush diameter in order to achieve a constant circumferential speed. This feature permits further improvement of the cleaning efficiency with decreasing brush diameters, whereby for control of this measure it is possible to use the same means as presently exist for the adjustment of the sweeping surface.

With the measuring apparatus according to the second method embodiment, it is possible to determine the actual spacing between the axis of the revolving brush and the surface to be cleaned, and the optimum spacing of the brush axis from the surface can be fixed with the control arrangement additionally provided for comparing the nominal spacing with the actual spacing of the brush axis from the surface to be cleaned and for generating an adjustment derived from such comparison.

It must be stressed that with both the method and apparatus of the present invention, the spacing of the brush axis from the surface to be cleaned is measured as the sweeping equipment is in operation.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
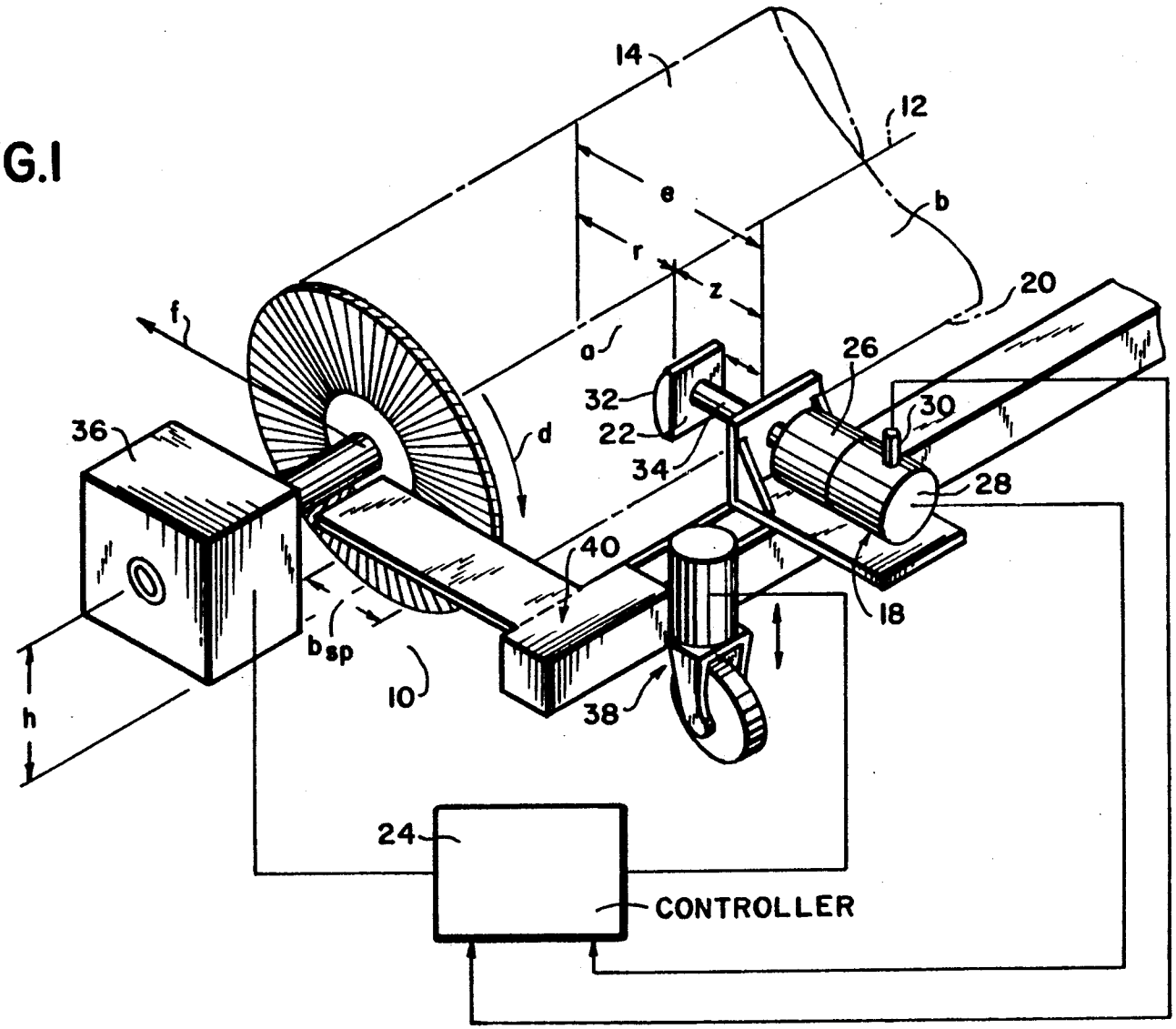
FIG. 1 is a perspective view of a schematic representation of a first embodiment of the apparatus according to the present invention.
Figure 3:
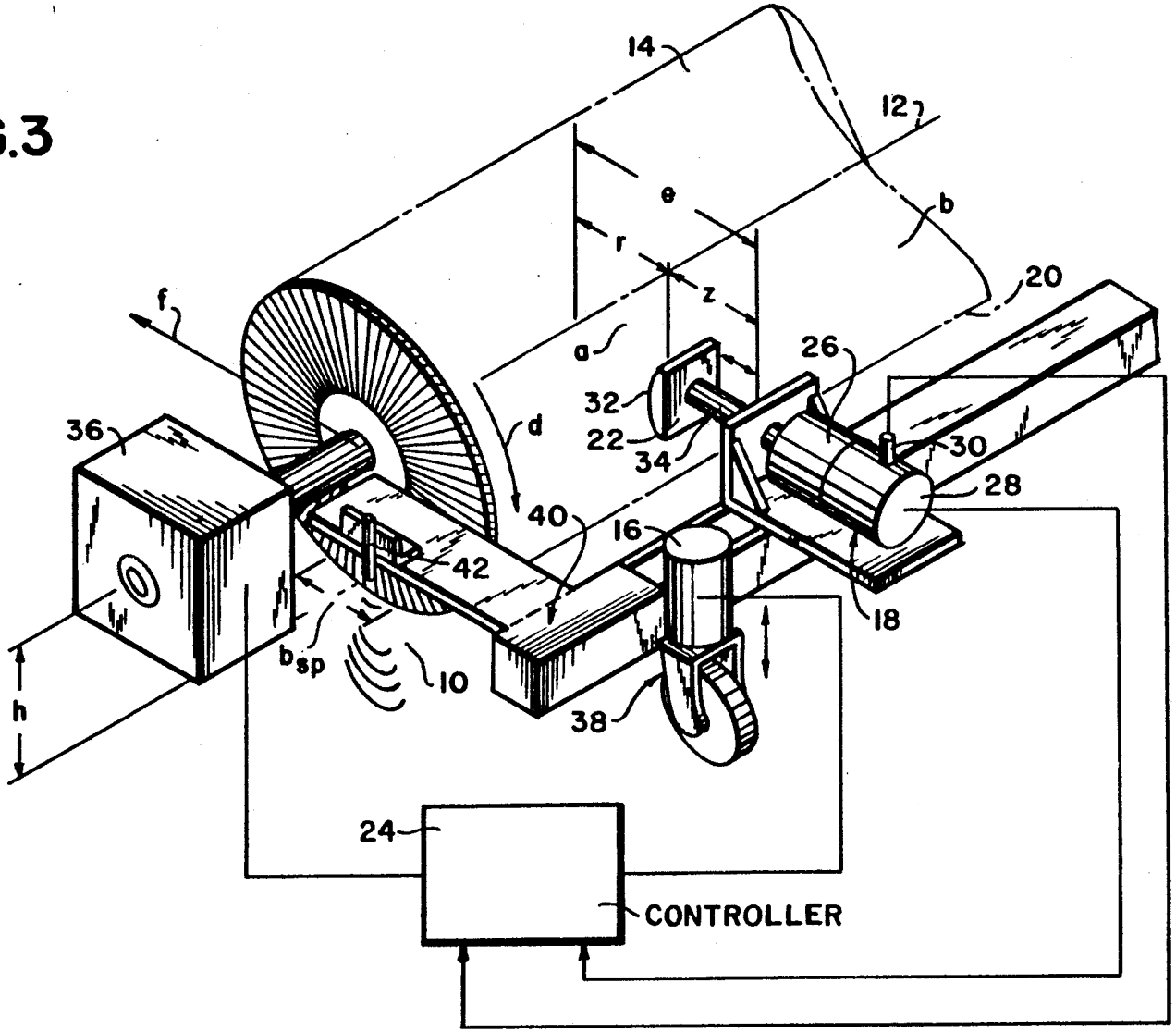
FIG. 3 is a perspective view of a schematic representation of a second embodiment of the apparatus according to the present invention.

Now turning to the drawings, there is shown in FIGS. 1 and 3 the apparatus for cleaning surfaces which is, as a rule, arranged on a special utility vehicle and connected to the latter by means of a support and guide frame 40. Guide frame 40 supports a revolving roll-type brush 14 rotatable around an axis 12, and is supported on surface 10 to be cleaned by means of a support and guide device 38, with its spacing h being adjustable by means of an adjuster 16.

By virtue of the adjustability of the spacing h, it is possible to adjust the contact area between revolving brush 14 and surface 10, this area being referred to as sweeping surface $b_{sp}$.

Revolving brush 14 is driven by a driving device 36 in the direction of rotation d and, in the course of the sweeping operation, the device is simultaneously driven across the surface to be cleaned in the direction f. Spacing h, which is variable by means of adjuster 16, and the size of the sweeping surface $b_{sp}$ associated therewith, are of decisive importance to the cleaning result. For this reason, adjusting device 16 is supplied with control signals from a controller 24, which determines the actual diameter of the revolving roll-type brush by means of sensor 18. Sensor 18 compriss a scanning body 22 mounted on a bar 34 and which, by means of an advancing device 26, can be displaced towards or away from revolving brush 14. In addition, provision is made for a distance measuring device 28 as well as for an acceleration receiver 30.

In order to determine the revolving brush diameter 2r, scanning body 22 is first displaced in the direction of the revolving brush by means of advancing device 26. Advancing device 26 is arranged in such a way that the direction of displacement thereof towards axis 12 is perpendicular thereto. In its starting position, scanning body 22 is spaced from axis 12 by the distance e.

When scanning body 22, with its surface 32, comes into contact with jacket surface 20 of the revolving brush, oscillation is induced in body 22 by the bristles of revolving brush 14 stroking across surface 32. These oscillations can be detected, for example as body sound by means of acceleration receiver 30 which may then cause controller 24 to stop advancing device 26.

Subsequently, displacement distance z which surface 32 travels can be detected by distance measuring device 28 and the diameter of revolving brush 14 can then be determined from the difference between original spacing e and displacement distance z. Following the detection of the displacement distance, scanning body 22 can be returned to its starting position in the opposite direction.

Based on brush diameter 2r so determined, spacing h required for a preselected sweeping surface $b_{sp}$ can be determined according to the following formula:

$$h = \sqrt{r^2 - \tfrac{1}{4} \cdot b_{sp}^2}$$

In the drawing it is seen that surface 32 of scanning body 22 facing jacket surface 20 of revolving brush 14 is convex. This has the advantage that the bristles of revolving brush 14 will gradually run up and off surface 32, which prevents excessive wear of scanning body 22 and also of revolving brush 14 at the point of contact.

In addition, a very clear contact position of scanning body 22 with jacket surface 20 of revolving brush 14 is obtained, which in turn offers the advantage that the desired sweeping surface $b_{sp}$ can be adjusted with great accuracy and that optimum cleaning results can therefore be obtained.

In order to determine the evenness of the diameter of roll-type brush 14, the diameter is usefully measured at a number of measuring points, e.g. at points a and b. For this purpose, provision can be made for two sensors 18, or a single sensor 18 can be used which can be displaced axially relative to the various measuring points, e.g. a and b.

When it is found that brush wear is uneven, revolving brush 14 can be adjusted relative to surface 10 in such a way that such uneveness in wear is compensated for and the equipment continues to operate with a uniform sweeping surface $b_{sp}$. In this way, cleaning effiency can be kept at an optimum across the total width of the brush until roll-type brush 14 is completely worn out.

Preferably, scanning body 22 is moved against jacket surface 20 of revolving brush 14 only at preselected time intervals and subsequently retracted again. This, too, reduces the wear of both scanning body 22 and revolving brush 14. Since the acquisition of the measured values requires a short time period, the measurements can be repeated at short time intervals, which permits monitoring and measuring of brush diameter 2r as required in light of the problem of the invention while retaining at the same time the advantages of low wear in the presence of increased wear of the brush.

For the purpose of further enhancing cleaning efficiency, driving device 36 for revolving brush 14 is connected with controller 24 as well. Controller 24 can be adapted to control revolving brush 14 in such a way that its rotational speed is changed in dependance on the diameter 2r of revolving brush 14 so as to obtain a constant circumferential speed. For such control it is possible to make use of the afore-described sensor 18 and controller 24.

Figure 2:
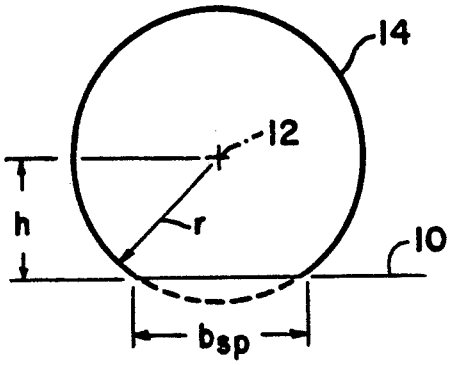
FIG. 2 is a schematic side elevational view of a revolving roll-type brush during the cleaning operation.

FIG. 2 shows a schematic side view of revolving brush 14 during the sweeping operation. During such operation, a contact area is established between revolving brush 14 and surface 10 to be swept, such contact area being shown as the sweeping surface $b_{sp}$. In addition, spacing h and the half brush diameter r are shown. Based on said quantities it is possible to derive the relationships between spacing h, brush diameter 2r and sweeping surface $b_{sp}$ according to the formula indicated above.

In the manner described above it is possible to determine and adjust, on the basis of the determined brush diameter 2r, the spacing of brush axis 12 from surface 10 required for a given sweeping area $b_{sp}$. However, what is still missing is a control over the actual spacing $h_{ist}$ that is in fact present after the adjustment. Such actual spacing is decisive for the actual width of the swept area, or sweeping surface. As clearly seen in FIG. 3, spacing h of axis 12 from and above surface 10 is continuously determined in order to permit not only a rigid adjustment but a regulation of the spacing of axis 12 from surface 10 and thus an optimum setting of the desired sweeping surface width $b_{sp}$. For this purpose, an ultrasound sensor 42 is arranged on support frame 40 as shown in FIG. 3. Ultrasound sensor 42 continuously determines the actual spacing $h_{ist}$. The level or height of the static resting position of axis 12 above surface 10 is determined by forming an average time value of the measure of the spacing relative to surface 10, such measure being supplied by ultrasound sensor 42. Together with the afore-described measurement of brush diameter 2r it is now possible to fix, on the basis of the formula stated above, the nominal value of height $h_{soll}$ of axis 12 for controlling the height or level h of axis 12 above surface 10.

Figure 4:
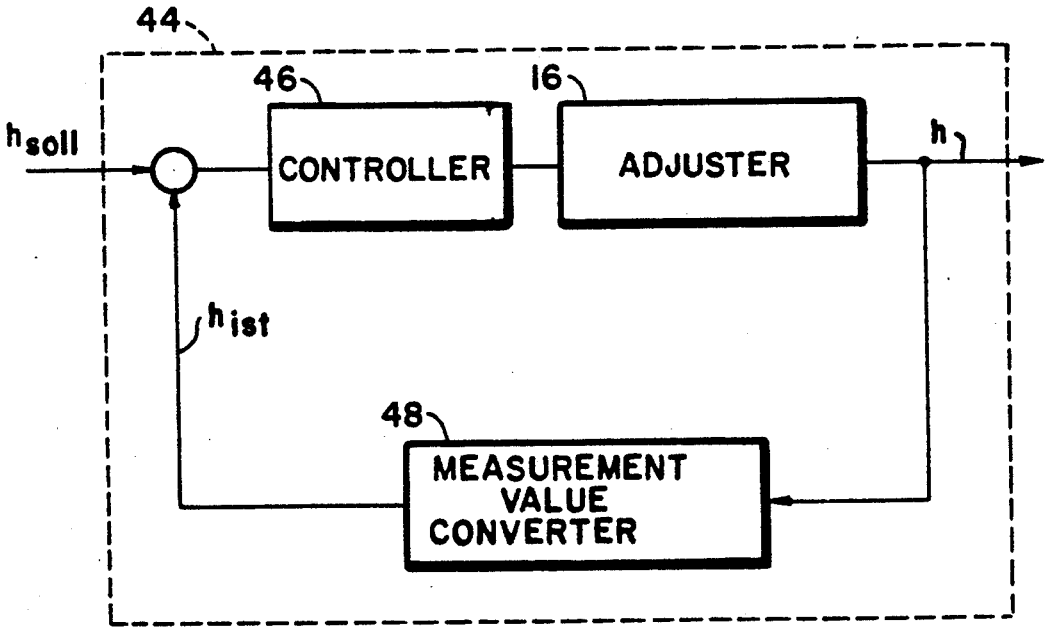
FIG. 4 is a general circuit diagram of a control circuit for the apparatus according to FIG. 3.

By means of control arrangement 44 shown in FIG. 4, it is possible to maintain revolving brush 14 above surface 10 in such a way that preselected sweeping surface width $b_{sp}$ is always assured. Control arrangement 44 comprises a controller 46, to which adjuster 16 is connected downstream. Adjuster 16 is followed by a measurement value converter 48, which closes the control circuit. If a deviation occurs between the nominal spacing $h_{soll}$ determined based on brush diameter 2r and the determined actual spacing $h_{ist}$, control arrangement 44 effects a readjustment in the sense that the nominal spacing is adjusted by means of adjuster 16 in order to maintain the preselected sweeping surface width $b_{sp}$.

While only two embodiments of the present invention have been shown and described, it will be obvious that many changes and modifications may be made thereunto without departing from the spirit and scope of the invention.

What is claimed is:

1. A method of sweeping comprising adjusting a preselected sweeping surface width of a roll-type brush rotatable about an axis for the cleaning of surfaces such as roads, airport runways, wherein the spacing between the axis and the surface to be cleaned is altered by adjusting the sweeping surface, and wherein the roll diameter is detected by means of a sensor for the dimensioning of the nominal spacing of the roll diameter by bringing a scanning body into contact with the jacket surface of the revolving roll-type brush and by determining and adjusting the required spacing as deduced therefrom, said method comprising while sweeping a surface advancing the scanning body first in the direction of the revolving roll-type brush at preset time intervals until contact with the jacket surface of the revolving brush is indicated by an altered signal of an acceleration recorder;

discontinuing the advance when such contact is indicated; and measuring the distance of displacement of the scanning body to determine the diameter of the roll based on the displacement at a number of selectable measuring sites.

2. A method of sweeping comprising adjusting a preselected sweeping surface width of a revolving roll-type brush rotatable about an axis for the cleaning of surfaces such as roads, airport runways, wherein the spacing between the axis and the surface to be cleaned is altered for adjusting the sweeping surface, and wherein the roll diameter is detected by means of the displacement of a sensor for the dimensioning of the nominal spacing of the roll diameter by bringing a scanning body into contact with the jacket surface of the revolving roll-type brush and the required spacing is determined and adjusted as deduced therefrom, said method comprising while sweeping a surface measuring the actual spacing between the axis and the surface to be cleaned with a measuring system;

comparing the measured actual spacing between the axis and the surface to be cleaned with the nominal spacing resulting from the detected roll diameter;

readjusting the nominal spacing in case of deviations between the actual and nominal spacings, and;

determining the diameter of the roll-type brush based on the displacement at a number of selectable measuring sites.

3. The method as defined in claim 1, wherein there are at least two different measuring sites; and wherein the roll-type brush diameter is determined on at least two different measuring sites of the jacket surface of the revolving roll-type brush.

4. The method as defined in claim 1, wherein there are several preset time intervals; and wherein the scanning body is applied to the jacket surface at the preset time intervals.

5. The method as defined in claim 1, wherein contact with the jacket surface of the revolving roll-type brush is determined by body sound variations.

6. The method as defined in claim 1, which further comprises controlling the rotational speed of the revolving roll-type brush depending on the roll diameter so as to maintain a constant circumferential speed of the brush.

7. The method as defined in claim 2, which further comprises continuously measuring the spacing between the axis of the roll-type brush and the surface to be cleaned.

8. The method as defined in claim 7, which further comprises forming a mean value of the measured values supplied by the measuring system in terms of time in order to deduce the actual spacing.

9. The method as defined in claim 8, wherein an ultrasound sensor is used in the measuring system.

10. The method as defined in claim 2, wherein there are different measuring sites on the axis; and wherein the actual spacing is determined along different measuring sites of the axis.

11. Apparatus of sweeping comprising adjusting a preselected sweeping surface width of a roll-type brush rotatable about an axis for the cleaning of surfaces such as roads, airport runways, wherein an adjustor for adjusting the spacing between the brush axis and the surface to be cleaned adjusts the sweeping surface, said apparatus comprising while sweeping a surface a sensor for detecting the roll-type brush diameter, said sensor comprising a scanning body capable of being brought into contact with the jacket surface of the roll-type brush, and a measuring and controlling device arranged between the sensor and the adjustor, said measuring and controlling device adjusting the sweeping surface of the roll-type brush via the adjustor depending on the roll diameter, wherein the sensor comprises an advancing device having the scanning body arranged thereon, a distance measuring device and an acceleration receiver.

12. Apparatus of sweeping comprising adjusting a preselected sweeping surface width of a roll-type brush rotatable about an axis for the cleaning of surfaces such as roads, airport runways, wherein an adjustor for the spacing between the brush axis and the surface to be cleaned adjusts the sweeping surface, said apparatus comprising while sweeping a surface a sensor for detecting the roll-type brush diameter, said sensor including a scanning body adopted to be brought into contact with the jacket surface of the roll-type brush, and a measuring and controlling device arranged between the sensor and the adjustor, said measuring and controlling device adjusts the sweeping surface of the roll-type brush via the adjustor depending on the roll diameter, a measuring device for determining the actual spacing between the brush axis and the surface to be cleaned, and a controlling arrangement for comparing the nominal spacing between the brush axis and the surface to be cleaned with the actual spacing and for generating an adjusting quantity for adjusting the spacing between the brush axis and the surface to be cleaned to the nominal spacing.

13. The apparatus as defined in claim 11, wherein the scanning body has a convex surface facing the jacket surface of the roll-type brush; and the apparatus further comprises an advancing device having a bar on which said scanning body is arranged, said bar being displaceable towards and away from said jacket surface.

14. The apparatus as defined in claim 11, wherein there are at least two different measuring sites for the jacket surface; and wherein at least two sensors are arranged along different measuring sites of the jacket surface of the roll-type brush.

15. The apparatus as defined in claim 12, wherein there are at least two different measuring sites for the jacket surface; and wherein at least two sensors are arranged along different measuring sites of the jacket surface of the roll-type brush.

16. The apparatus as defined in claim 11, wherein there are different measuring sites for the brush; and wherein said sensor is adapted for displacement axially to the roll-type brush to different measuring sites.

17. The apparatus as defined in claim 11, further comprising means for measuring preset time intervals; and wherein the scanning body contacts the jacket surface only at preset time intervals.

18. The apparatus as defined in claim 11, wherein the acceleration receiver is designed as a body sound receiver.

19. The apparatus as defined in claim 11, which further comprises a driving device for the roll-type brush, said driving device being in communication with said measuring and controlling device so that the rotational speed of the roll-type brush is controlled so as to depend on the roll diameter to achieve a constant circumferential speed of the brush.

20. The apparatus as defined in claim 12, wherein said measuring device comprises an ultrasound sensor disposed on a support and guide frame of the roll-type brush.

21. The apparatus as defined in claim 20, wherein at least two ultrasound sensors are each arranged at a different location in the direction of the axis of the roll-type brush.

22. The apparatus as defined in claim 12, wherein said sensor includes an advancing device having said scanning body arranged thereon, a distance measuring device, and an acceleration receiver.

* * * * *